US012492572B2

(12) United States Patent
Lentowich et al.

(10) Patent No.: US 12,492,572 B2
(45) Date of Patent: Dec. 9, 2025

(54) INSULATED TENSIONED SHEET WALL SYSTEM FOR A BUILDING

(71) Applicant: GNB GLOBAL INC., Selkirk (CA)

(72) Inventors: Alexander Paul Lentowich, Cooks Creek (CA); Ryan Brand Hunter, Cooks Creek (CA)

(73) Assignee: GNB Global Inc., Selkirk (CA)

( * ) Notice: Subject to any disclaimer, the term of this patent is extended or adjusted under 35 U.S.C. 154(b) by 420 days.

(21) Appl. No.: 18/192,321

(22) Filed: Mar. 29, 2023

(65) Prior Publication Data

US 2023/0366231 A1 Nov. 16, 2023

(30) Foreign Application Priority Data

May 13, 2022 (CA) ..... 3158774

(51) Int. Cl.

| | |
|---|---|
| ***E04H 15/12*** | (2006.01) |
| ***E04B 1/76*** | (2006.01) |
| ***E04H 9/16*** | (2006.01) |
| ***E04H 15/18*** | (2006.01) |
| ***E04H 15/20*** | (2006.01) |

(Continued)

(52) U.S. Cl.

CPC ..... *E04H 15/322* (2013.01); *E04B 1/7666* (2013.01); *E04H 9/16* (2013.01); *E04H 15/18* (2013.01); *E04H 15/36* (2013.01); *E04H 15/64* (2013.01); *E04H 2015/207* (2013.01)

(58) Field of Classification Search

CPC .... E04B 1/7666; E04B 2001/268; E04B 1/32; E04B 1/78; E04B 2002/7479; E04B 2009/0492; E04B 9/303; E04B 9/0692; E04B 9/521; E04H 2015/207; E04H 15/16; E04H 15/322; G09F 15/0025; E04F 13/005

USPC ..... 135/115, 119, 124, 120.3, 906, 908; 52/222, 273, 63, 86; 160/328; 40/603, 40/604

See application file for complete search history.

(56) References Cited

U.S. PATENT DOCUMENTS 2,869,561 A * 1/1959 Harkness ..... E04H 15/36 135/120.2
4,304,824 A * 12/1981 Karpinski ..... E04B 1/78 428/72

(Continued)

FOREIGN PATENT DOCUMENTS

JP 2012149658 A * 8/2012 ..... E04B 1/78

*Primary Examiner* — Robert Canfield
(74) *Attorney, Agent, or Firm* — Ryan W. Dupuis; Michael R. Williams; Ade & Company Inc.

(57) ABSTRACT

An insulated wall system for a building includes a sheet assembly spanning across an opening in a building frame. The sheet assembly includes an outer plastic sheet member at an, an inner plastic sheet member at an interior, and a core layer of heat insulating material between the inner and outer sheet members. One or more perimeter boundaries of the sheet assembly includes a tensioning pocket formed on the inner sheet member to receive a frame member therein such that a tensioning mechanism can apply tension between the frame member in the pocket and a corresponding boundary of the building opening to tension the sheet assembly. The outer sheet member is joined to the inner sheet member about a perimeter while the core layer is bonded to both sheet members to transfer tension of the inner sheet member through all layers of the sheet assembly.

15 Claims, 8 Drawing Sheets

(51) Int. Cl.

| | |
|---|---|
| ***E04H 15/32*** | (2006.01) |
| ***E04H 15/36*** | (2006.01) |
| ***E04H 15/64*** | (2006.01) |

(56) References Cited

U.S. PATENT DOCUMENTS 4,800,947 A * 1/1989 Loomis ..... G09F 15/0025 160/368.1
5,290,904 A * 3/1994 Colvin ..... F16L 59/029 428/920
5,333,425 A * 8/1994 Nickerson ..... E04H 15/644 52/273
5,373,653 A * 12/1994 Suzuki ..... G09F 21/04 40/607.13
5,408,770 A * 4/1995 Suzuki ..... E04G 21/3204 160/368.1
5,507,109 A * 4/1996 Rinzler ..... G09F 21/04 40/590
5,555,659 A * 9/1996 Hade ..... G09F 17/00 40/604
6,101,751 A * 8/2000 Hicks ..... G09F 21/048 40/590
6,176,050 B1 * 1/2001 Gower ..... E04H 9/14 135/90
6,599,850 B1 * 7/2003 Heifetz ..... B32B 5/024 442/232
6,904,720 B1 * 6/2005 Adolfson ..... E04G 21/24 52/762
7,735,502 B1 * 6/2010 Hotes ..... E04H 15/64 52/63
7,814,714 B2 * 10/2010 McGary ..... E04H 7/22 52/63
7,882,849 B2 * 2/2011 Franta ..... E04H 15/001 135/901
8,327,565 B2 * 12/2012 Boltz ..... G09F 17/00 40/606.18
8,402,682 B2 * 3/2013 Boltz ..... G09F 15/0025 40/604
8,728,605 B2 * 5/2014 Payne ..... B32B 5/22 428/68
8,997,767 B2 * 4/2015 Hotes ..... E04H 15/322 52/63
9,777,507 B2 * 10/2017 Walter ..... E04H 15/322
9,938,735 B2 * 4/2018 Gower ..... E04G 21/3266
10,094,134 B2 * 10/2018 Hotes ..... E04H 15/14
10,094,139 B2 * 10/2018 Hotes ..... E04H 15/10
10,550,634 B1 * 2/2020 Holland ..... E06B 9/06
10,947,776 B1 * 3/2021 Lentowich ..... E04G 5/12
2011/0094555 A1 * 4/2011 Franta ..... E04H 15/001 135/115
2016/0046096 A1 * 2/2016 Squires ..... B32B 27/40

* cited by examiner

INSULATED TENSIONED SHEET WALL SYSTEM FOR A BUILDING

This application claims foreign priority benefits from Canadian Patent Application 3,158,774 filed May 13, 2022.

FIELD OF THE INVENTION

The present invention relates to a tensioned sheet wall system in which flexible sheet material is tensioned to span across the frame of a building, for example in a fabric-walled building or to provide a temporary weather enclosure supported on the frame of a building while the building is under construction, and more particularly the present invention relates to a tensioned sheet wall system which is heat insulated.

BACKGROUND

Fabric walled buildings are commonly used where it is desired to erect a building structure quickly and in a cost-effective manner. Although these buildings are effectively at protecting contents from wind and precipitation, it is difficult to effectively insulate the fabric material of the walls of the building such that fabric buildings typically offer poor heat insulating properties to the contents of the building.

In other instances, tensioned fabric can be used during the construction of large commercial buildings, as a temporary means of enclosing the posts and beams of the building frame before permanent walls of the building can be constructed. Again, such tensioned fabric walls tend to offer poor heat insulating properties to the contents of the building while the fabric walls remain in use.

Due to the flexible nature of the fabric walls which may be subjected to fluctuating winds forces, it is difficult to effectively secure traditional building insulation to the flexible fabric walls.

SUMMARY OF THE INVENTION

According to one aspect of the invention there is provided an insulated wall system for a building including a rigid frame defining at least one wall opening spanning between first and second ends of the wall opening, the wall system comprising:

a flexible sheet assembly spanning a length in a longitudinal direction between opposing first and second ends of the flexible sheet assembly and spanning a width in a lateral direction perpendicular to the longitudinal direction between opposing sides of the flexible sheet assembly, the flexible sheet assembly comprising:

(i) an outer sheet member defining a first plastic barrier spanning an exterior side of the flexible sheet assembly;

(ii) an inner sheet member defining a second plastic barrier spanning an interior side of the flexible sheet assembly and being joined to the outer sheet member along perimeter edges of the sheet members;

(iii) a core layer formed of a heat insulating material received between the inner and outer sheet members; and (iv) a tension pocket formed on the inner sheet member to extend in the lateral direction across the flexible sheet assembly in proximity to the second end of the flexible sheet assembly;

a first frame member arranged to be secured to the flexible sheet assembly in proximity to the first end of the flexible sheet assembly so as to span across the flexible sheet assembly in the lateral direction of the flexible sheet assembly, the first frame member being arranged to be secured relative to the rigid frame of the building at the first end of the wall opening;

a second frame member arranged to be received in the tension pocket to extend in the lateral direction across the flexible sheet assembly in proximity to the second end of the flexible sheet assembly; and a tensioning assembly arranged to be operatively connected between the second frame member and the rigid frame of the building at the second end of the wall opening whereby the tensioning assembly is arranged to apply tension in the longitudinal direction to the inner sheet member of the flexible sheet assembly between the first and second frame members.

When using a flexible sheet assembly formed in layers in which the inner and outer sheet members are joined at the perimeter thereof and the core layer is optionally bonded to one or more of the sheet members, together with one or more tensioning pockets formed on the inner sheet member, a tensioning mechanism can be used to apply tension through frame members in the tensioning pockets to the inner sheet member, resulting in the tensioning being transferred through to the core layer and outer sheet member as well. The resulting sheet assembly has effective heat insulating properties, while the various layers can flex together under fluctuating wind loads to remain adequately secured to one another.

Preferably the core layer is bonded to the outer sheet member along a first side of the core layer and bonded to the inner sheet member along a second side of the core layer such that the outer sheet member and the inner sheet member are integrally joined to one another across the length and across the width of the flexible sheet assembly.

The outer sheet member and the inner sheet member may be joined to one another at the first and second ends by plastic welds between peripheral portions of the first plastic barrier and the second plastic barrier extending fully across the width of the flexible sheet assembly, or extending about a full perimeter of the flexible sheet assembly at the perimeter edges of the sheet members.

The core layer may comprise a flexible sheet of material encapsulating air pockets therein in which the core layer is bonded fully across first side to the inner sheet member and bonded fully across the second side to the outer sheet member.

The flexible sheet assembly preferably further comprises an auxiliary pocket formed on the inner sheet member to extend in the lateral direction across the flexible sheet assembly in proximity to the first end of the flexible sheet assembly, in which the auxiliary pocket is arranged to receive the first frame member therein. In this instance, the system further comprises an auxiliary tensioning assembly arranged to be operatively connected between the first frame member and the rigid frame of the building at the first end of the wall opening whereby the auxiliary tensioning assembly is arranged to apply further tension in the longitudinal direction to the inner sheet member of the flexible sheet assembly between the first and second frame members.

The flexible sheet assembly may comprise a plurality of pockets formed on the inner sheet member and arranged to receive respective frame members therein such that the frame members extend about a full perimeter of the flexible sheet assembly. In this instance, the system preferably further comprises a plurality of tensioning assemblies operatively connected between the frame members and the rigid frame of the building about a perimeter of the wall opening whereby the tensioning assemblies are arranged to apply tension across the inner sheet member in both the longitudinal direction and the lateral direction.

When the rigid frame of the building includes a foundation defining a floor, arched trusses defining a semi-cylindrical wall supported along opposing sides of the floor, and two end frames defining end walls of the building at opposing ends of the semi-cylindrical wall, the system may be further arranged so that the flexible sheet assembly is arranged to extend over one or more of the arched trusses between the first and second ends of the flexible sheet assembly supported along the opposing sides of the floor of the building.

The flexible sheet assembly may further comprise an auxiliary pocket formed on the inner sheet member to extend in the lateral direction across the flexible sheet assembly in proximity to the first end of the flexible sheet assembly, in which the auxiliary pocket is arranged to receive the first frame member therein and said tensioning assembly is arranged to be operatively connected between the second frame member and a first one of the sides of the floor of the building, and in which the system further comprises an auxiliary tensioning assembly arranged to be operatively connected between the first frame member and a second one of the sides of the floor of the building.

An end flap preferably protrudes in a lateral direction from one side edge of the flexible sheet assembly along an upper perimeter of a corresponding one of the end walls of the building, in which the end flap includes a gathering pocket therein arranged to receive a gathering member such that the gathering member is arranged to constrict the end flap radially inwardly into overlapping arrangement with an upright exterior surface portion of the corresponding end wall.

When the rigid frame of the building includes a foundation defining a floor, arched trusses defining a semi-cylindrical wall supported along opposing sides of the floor, and two end frames defining end walls of the building at opposing ends of the semi-cylindrical wall, the system may be arranged so that the flexible sheet assembly is arranged to extend over one of the end walls between the floor and one of the arched trusses of the building. In this instance, the flexible sheet assembly preferably further comprises an auxiliary pocket formed on the inner sheet member in proximity to the first end of the flexible sheet to extend across the flexible sheet assembly along a semicircular path following an upper end of the end wall of the building, and in which the auxiliary pocket is arranged to receive the first frame member therein. The first tensioning assembly is thus arranged to be operatively connected between the second frame member and the floor of the building while an auxiliary tensioning assembly is preferably arranged to be operatively connected between the first frame member and one of the arched trusses of the rigid frame of the building. Preferably the auxiliary tensioning assembly is arranged to apply tension to the flexible sheet assembly in a radial direction towards said one of the arched trusses.

The flexible sheet assembly may further comprise (i) a door opening open to the second end of the flexible sheet assembly adjacent to the floor of the building, and (ii) a pair of intermediate pockets formed on the inner sheet member to extend between an upper boundary of the door opening and the first end of the flexible sheet member adjacent to laterally opposing ends of the upper boundary respectively. In this instance, the system may further comprise (i) an intermediate frame member received in each intermediate pocket and (ii) intermediate tension assemblies arranged to be operatively connected between the intermediate frame members and the rigid frame of the building so as to apply tension to the flexible sheet assembly above the door opening in a lateral direction.

According to one of the illustrated embodiments, the outer sheet member and the inner sheet member are joined to one another by plastic welds between the first plastic barrier and the second plastic barrier extending about a full perimeter of the flexible sheet assembly at the perimeter edges of the sheet members, and the flexible sheet assembly further comprises a row of grommets mounted along each side of the flexible sheet member within the peripheral portions of the inner and outer sheet members.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Referring to the accompanying figures, there is illustrated an insulated wall system for a building in which one or more walls of the building is a tensioned fabric sheet assembly as described in the following.

Figure 1:
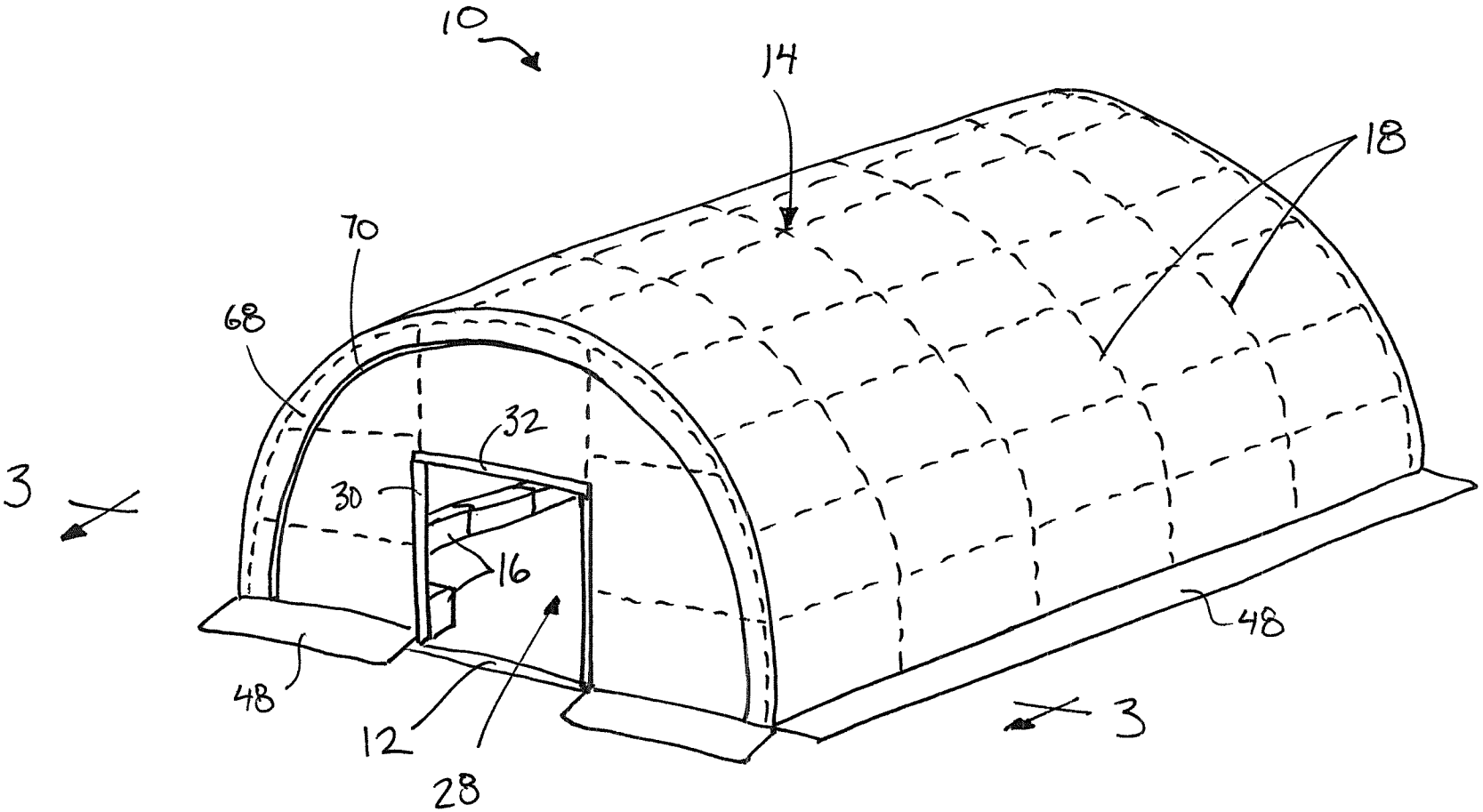
FIG. 1 is a perspective view of a fabric building upon which the insulated tensioned sheet wall system of the present invention has been applied.

According to a first embodiment of the insulated wall system, the wall system is adapted for use in a fabric building 10 of the type generally shown in FIG. 1. In this instance the building 10 includes a rigid frame that collectively includes a rectangular foundation 12 and a metal framework 14 supported on the rectangular foundation. The rectangular foundation 12 defines a floor of the building, for example a cement pad or compacted crushed stone and the like, along with a perimeter footing comprised of a series of concrete blocks 16 positioned adjacent one another about the full perimeter of the floor of the building.

The framework 14 of the building in this instance comprises a plurality of arched trusses 18 which are generally semicircular in shape so that each truss extends between opposing ends 20 of the trusses which are secured to respective blocks 16 at laterally opposing sides of the foundation which extend in the longitudinal direction of the building. The arched trusses 18 thus each span laterally across the width of the building while being spaced apart from one another in the longitudinal direction of the building between opposing ends of the floor. The trusses collectively define a generally semicylindrical side wall of the building. In the illustrated embodiment, each arched truss 18 includes an outer beam 22 defining the outer perimeter of the trusses and an inner beam 24 having a smaller radius of curvature and being spaced radially inward from the outer beam such that the inner and outer beams can be connected by a series of diagonal struts 26 connected between the inner and outer beams.

Figure 3:
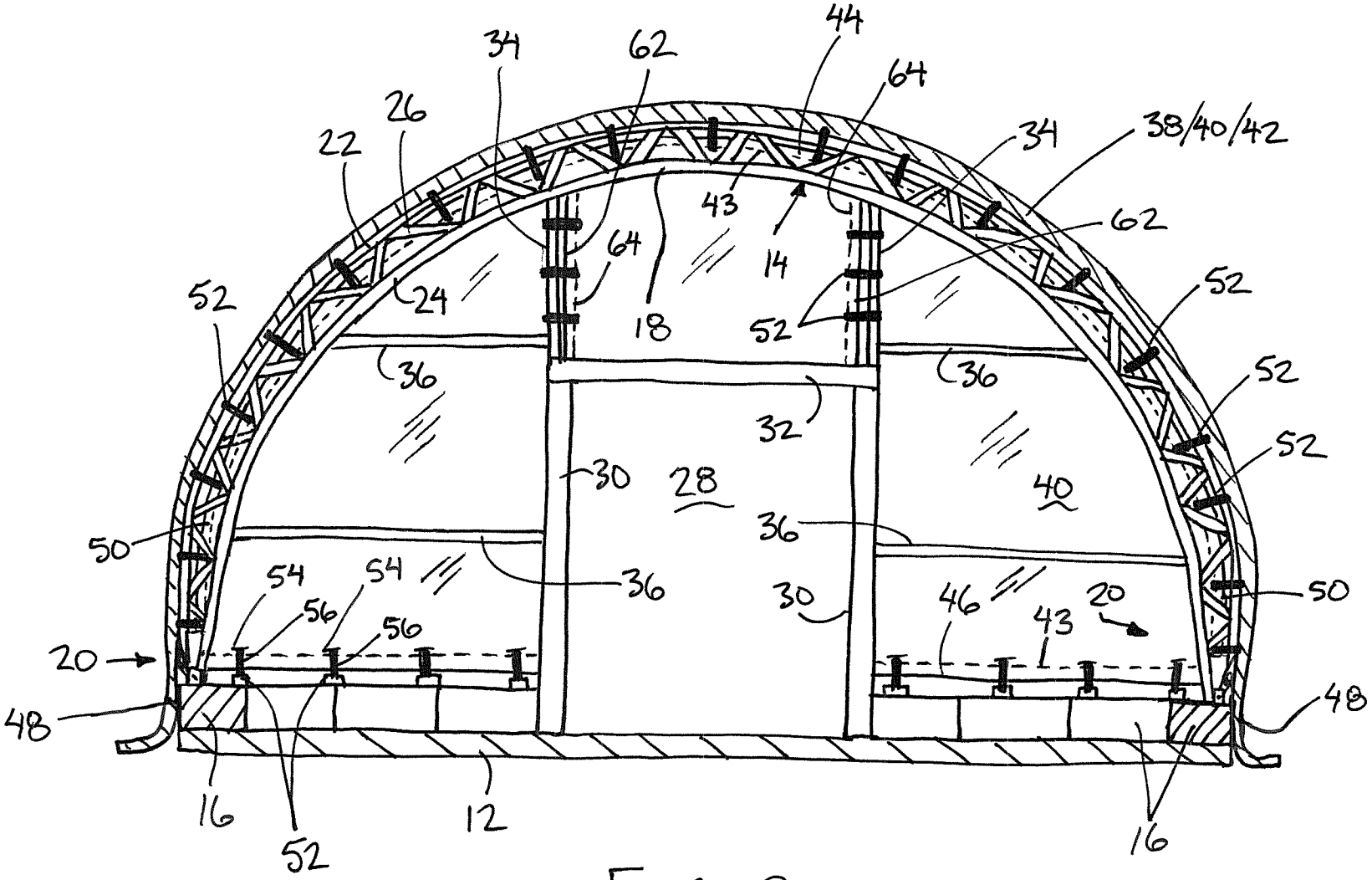
FIG. 3 is sectional view along the line 3-3 in FIG. 1 illustrating an inside elevational view of the end wall sheet assembly of FIG. 2 when supported on the rigid frame of the building according to FIG. 1.

The framework 14 of the building also includes two end frames as represented schematically in FIG. 1 and shown in greater detail in FIG. 3. Each end frame supports a semicircular end wall to enclose the longitudinally opposed ends of the building. When a door opening is provided, the door opening 28 is open to the bottom of the end frame and is bounded at laterally opposing sides by a pair of side posts 30 joined by a header 32 spanning across the top of the door opening. Typically, an overhead door is supported by the side posts and the header to be operatively associated with the door opening to open and close across the door opening.

The end frame further includes a pair of intermediate posts 34 extending upward from the header in proximity to the two side posts 30 respectively so that each intermediate post is vertically connected between the header 32 and the arched truss 18 at the corresponding end of the building above the end frame. The end frame further includes a plurality of crossbars 36 connected to extend horizontally and laterally outwardly from the side posts 30 and the intermediate posts 34 to respective portions of the arched truss 18 at the corresponding end of the building. The crossbars 36 are provided at different elevations to provide sufficient structural support to the perimeter framing about the door opening.

The wall system for a building 10 as shown in FIG. 1 comprises one or more side wall systems extending about the semicylindrical side of the building and two end wall systems extending vertically across longitudinally opposed ends of the building respectively. Each wall system, at the side wall or end wall, generally comprises a flexible sheet assembly comprised of three layers as described in the following. The flexible sheet assembly includes an outer sheet member 38 spanning an exterior side of the assembly and an inner sheet member 40 spanning the interior side of the assembly, and a core layer 42 between the inner and outer sheet members. Each of the inner and outer sheet members comprises a woven polyethylene plastic sheet defining a respective impermeable barrier of the assembly.

The core layer 42 consists of a heat insulating material that lies between the inner and outer sheet members. The core layer 42 is undersized relative to the inner and outer sheet members about the full perimeter such that each of the inner and outer sheet members protrude beyond the corresponding boundary of the core layer 42 about the full perimeter. For example, the sheet members may protrude by a distance in the order of 2 inches relative to the core layer such that the inner and outer sheet members can be plastic welded directly to one another and such that the inner and outer sheet members are fused together about the full perimeter of the sheet assembly. Furthermore, the core layer is fully bonded using a suitable adhesive at the first side to the outer sheet member and at the opposing second side to the inner sheet member so as to be bonded to both sheet members across the full width and length of the core layer. In this manner, the three layers of the sheet assembly remained joined one another while remaining flexible to follow the contour of the boundary of the building.

The core layer is a flexible sheet of material encapsulating air pockets therein. For example, the flexible sheet may consist of an open cell foam material or a closed cell foam material. More preferably, the flexible sheet is formed of two sheets of plastic material that are fused or welded together to define a plurality of closed bubbles or cells that contain air therein in a uniform grid pattern across the length and width of the sheet. The flexible sheet may further include a heat reflective foil layer bonded to one or both sides of the sheet that has the encapsulated air pockets formed therein to collectively define the core layer.

The sheet assembly further comprises a plurality of tensioning pockets integrally formed on the inner sheet member as an extra layer of material that is formed of the same plastic material as the inner sheet member so that the panel of material forming each tensioning pocket is formed into a loop that can be plastic welded onto the inner sheet member across the width or length of the sheet assembly. Each tension pocket is arranged to receive a rigid frame member 43 therein so that a suitable tensioning assembly or device can be used to apply tension between the rigid frame member 43 and the rigid frame of the building as described in further detail below.

In preferred embodiments the tension pockets include a first longitudinal tensioning pocket 44 and a second longitudinal tensioning pocket 46 at longitudinally opposed ends of the sheet assembly to span substantially the full width of the sheet in the lateral direction in proximity to opposing ends of the sheet. Each pocket is again fixed only to the inner sheet member by suitable plastic welding at a location in proximity to the respective end of the sheet assembly but at a location spaced inwardly from the end so that a remaining end portion 48 of the sheet assembly protrudes longitudinally outward beyond the pocket at each of the opposing ends of the sheet assembly.

The tension pockets also preferably include a pair of lateral tension pockets 50 supported in proximity to laterally opposing sides of the sheet assembly to extend substantially the full length of the sheet assembly in the longitudinal direction between the longitudinal tension pockets 44 and 46 at the opposing ends. The lateral tension pockets 50 are thus situated within the boundaries of the longitudinal tension pockets. The lateral tension pockets are also spaced inwardly from the corresponding boundaries of the flexible sheet by being supported on the inner sheet member so that a similar end portion 48 of the flexible sheet extends laterally outward beyond the corresponding lateral tension pocket 50.

A tensioning assembly for applying tension between frame members received within the pockets and corresponding portions of the rigid frame of the building typically comprises a plurality of individual tension devices 52 which are independently mounted at spaced apart positions along each frame member 43 within each pocket for applying tension to pull the frame member 43 outward towards a portion of the rigid building frame located adjacent to the corresponding boundary of the sheet assembly.

Each tension device 52 may comprise a strap connected to a ratcheting assembly to form a loop extending about the frame member in the pocket and a corresponding portion of the rigid frame of the building whereby tightening the ratcheting assembly shortens the loop to apply tension to the frame member in the corresponding pocket. Alternatively, the tension device 52 may comprise a strap formed in a loop and secured at one end onto the drum of a winch having a ratchet mechanism for winding the strap onto the winch to apply tension. Slots 54 are provided at spaced apart locations along each pocket to enable the straps 56 of the tension devices to be threaded through the slots and about the frame members in the pockets.

Figure 2:
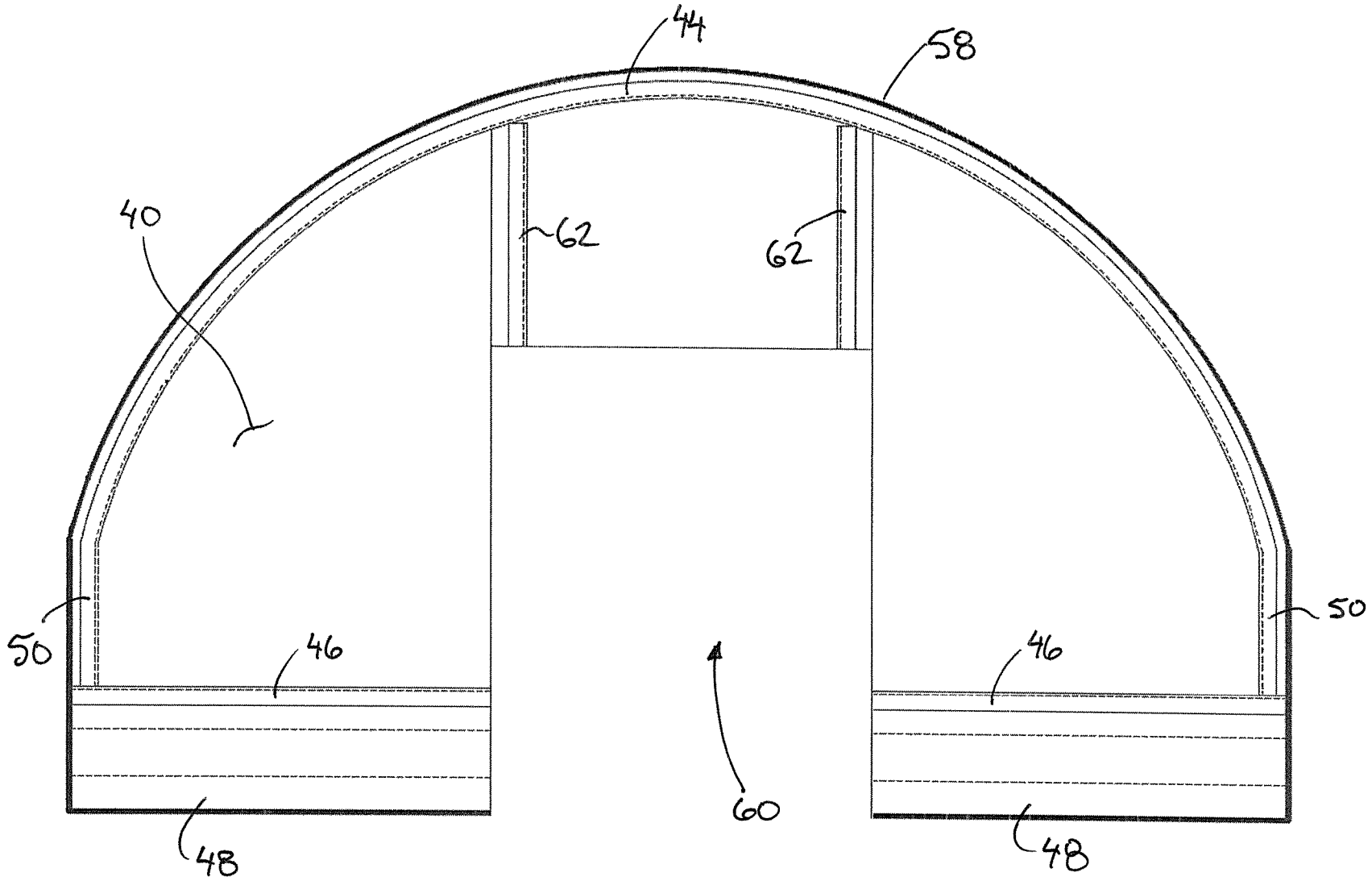
FIG. 2 is an inside elevational view an end wall sheet assembly for forming one of the end walls of the fabric building according to FIG. 1.

Each end wall system comprises a flexible sheet assembly which is formed to be generally semicircular in shape as shown in FIG. 2 for being supported on a corresponding end frame of the building as shown in FIG. 3. The sheet assembly in this instance includes a flat bottom edge for positioning in proximity to the floor of the building and a curved upper perimeter edge 58 which follows the curvature of an outermost one of the arched trusses 18 of the building frame against which the end wall system is supported. In the illustrated embodiment, a door opening 60 is formed in the flexible sheet assembly which is open to the bottom of the sheet assembly at a central location.

In this instance the first longitudinal tensioning pocket 44 follows the curved profile of the upper perimeter edge 58 of the sheet assembly at a location spaced radially inward therefrom while also being continuous with the lateral tension pockets 50 at opposing sides of the sheet assembly. The frame member received within the first longitudinal tensioning pocket 44 in this instance is also curved to follow the upper perimeter edge 58 of the sheet assembly while being continuous with corresponding frame members within the lateral tensioning pocket portions 50. The upper tensioning assembly comprises a plurality of tension devices in the form of straps which are connected between the curved frame member and the arched truss 18 at the corresponding end of the building with ratchet mechanisms that enable the straps to be tensioned to apply tension in a radially outward direction at spaced positions about the circumference of the arched truss. The upper tensioning assembly thus applies a longitudinal tension upwardly along a central portion of the end wall system while the portions of the upper tensioning assembly towards opposing sides of the sheet apply a more lateral tension to the lower portion of the sheet assembly.

The second longitudinal tensioning pocket 46 is provided along the bottom edge in two sections corresponding to the two sections of the bottom edge of the sheet assembly on either side of the door opening 60. The second frame member in this instance comprises two sections received within the two sections of the second longitudinal tensioning pocket 46.

The lower tensioning assembly comprises a plurality of tension devices in the form of straps connected between the lower frame members in the second longitudinal tension pockets 46 and the concrete blocks 16 of the building frame along the bottom of the end wall at laterally spaced apart positions along each frame member. The lower tensioning assembly thus applies longitudinal tension across the width of each section of the second longitudinal pockets 46.

The end wall system further includes two intermediate pockets 62 formed similarly to the other tension pockets to extend alongside the intermediate posts 34 of the end frame respectively so that each intermediate pocket is at a location spaced slightly laterally inward from the respective intermediate post 34. An intermediate tensioning assembly is provided in the form of a plurality of tension devices 52 connected between an intermediate frame member 64 within each intermediate pocket 62 and the corresponding intermediate post 34 at vertically spaced positions along the intermediate pocket. The tension devices comprise straps 56 with connected ratcheting mechanisms to shorten the straps and thereby apply outward lateral tension to the inner sheet member of the sheet assembly at each intermediate tension pocket for providing lateral tension to the portion of the sheet assembly of the end wall above the door opening.

As in other configurations of the wall system, an end portion 48 of the sheet assembly protrudes outward beyond the tension pockets about the full perimeter of the end wall. The end portion 48 along the upper perimeter edge of the end wall is fastened to the outermost arched truss 18 at the corresponding end of the building by a plurality of perimeter ties 66 which are strapped or tied about corresponding portions of the frame to secure the non-tensioned end portion 48 along the upper perimeter edge of the wall system. Along the bottom of the end wall system, the end portion 48 has sufficient length to span a distance from the bottom frame members in the second longitudinal tension pockets 46 to the ground, as well as further overlap a portion of the ground to enable weighted material to be placed on the outer edge of the end portion and thereby secure the end portion snugly to the ground. The core layer preferably extends at least to ground level to maximize the insulated boundary of the building.

Turning now to the side wall system, the wall system in this instance again comprises a flexible sheet assembly formed in layers as described above in which the longitudinal direction that the sheet assembly spans corresponds to extending over the arched trusses to be secured at longitudinally opposed first and second ends in proximity to the sides of the foundation that extend longitudinally between opposing ends of the building.

In some instances, the side wall of the building may be formed by a plurality of flexible sheet assemblies which are joined side by side with one another across the length of the building; however, in the illustrated embodiment the entirety of the side wall of the building is formed by a single flexible sheet assembly so that the laterally opposing side edges of the sheet assembly are secured to the outermost arched trusses at opposing ends of the building.

Figure 4:
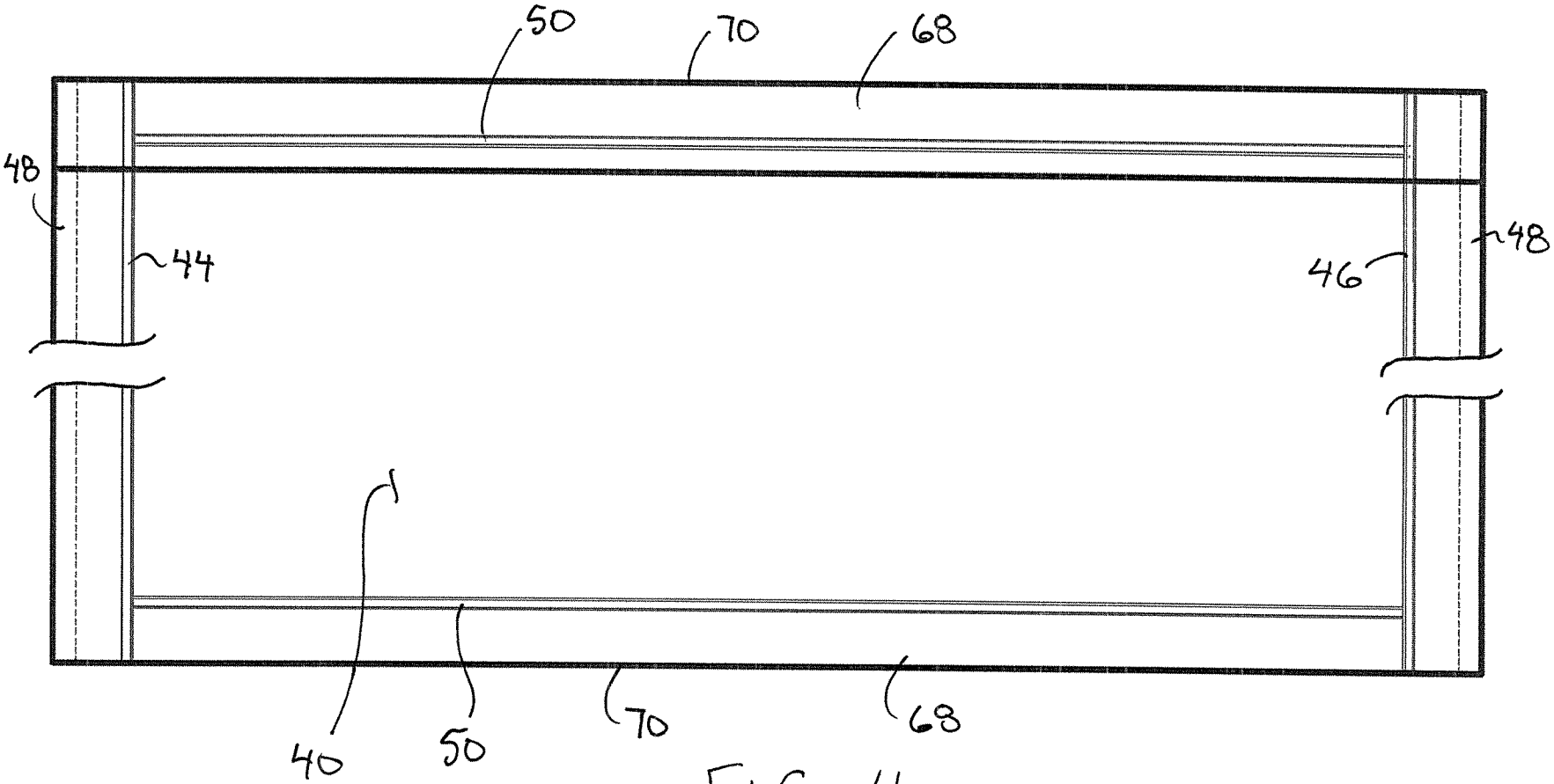
FIG. 4 is an inside elevational view of a side wall sheet assembly for forming the partially cylindrical wall of the fabric building according to FIG. 1.
Figure 5:
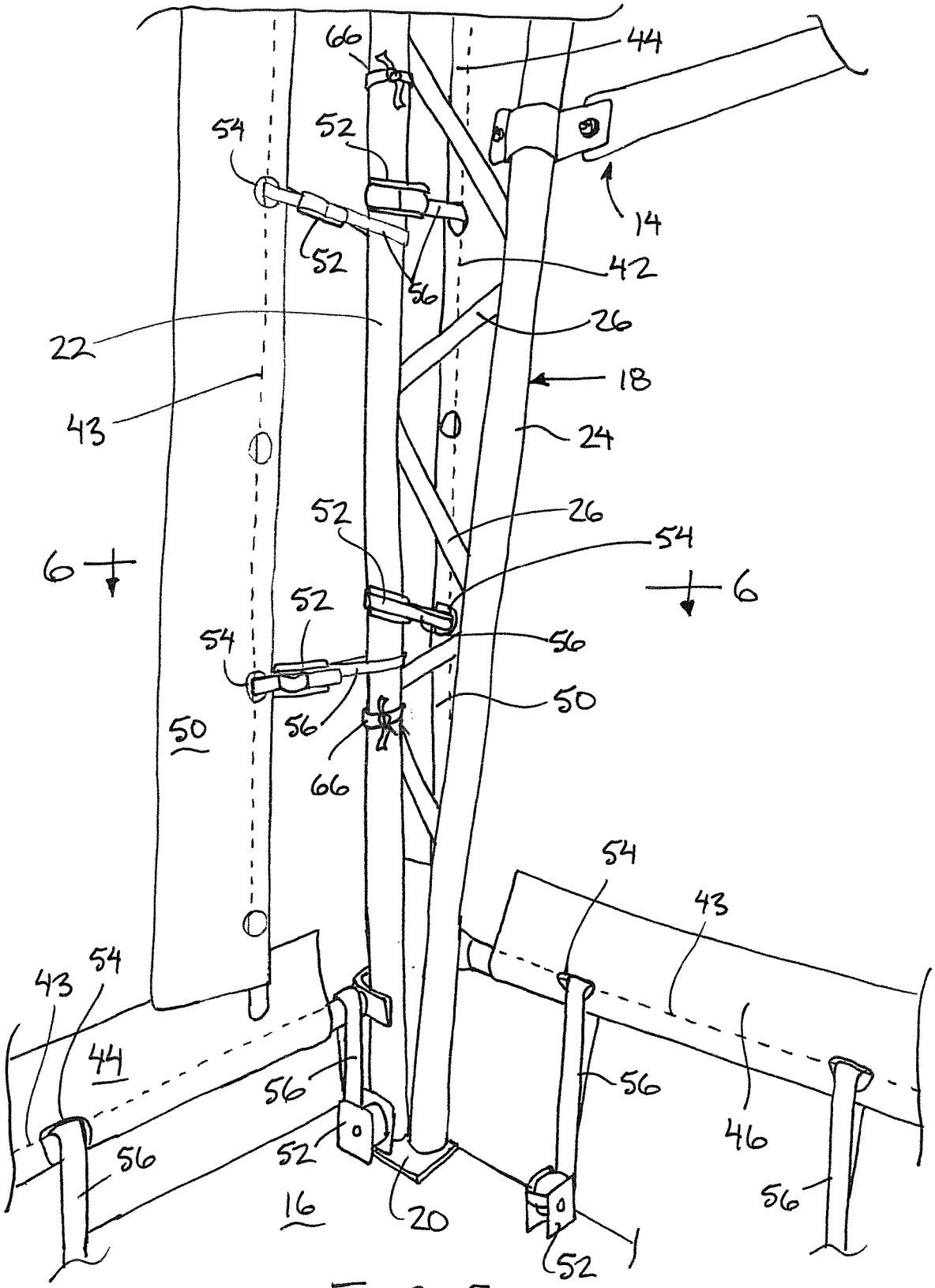
FIG. 5 is a perspective view of an inside corner of the building according to FIG. 1 at a junction of the end wall sheet assembly of FIG. 2 and the side wall sheet assembly of FIG. 4.
Figure 6:
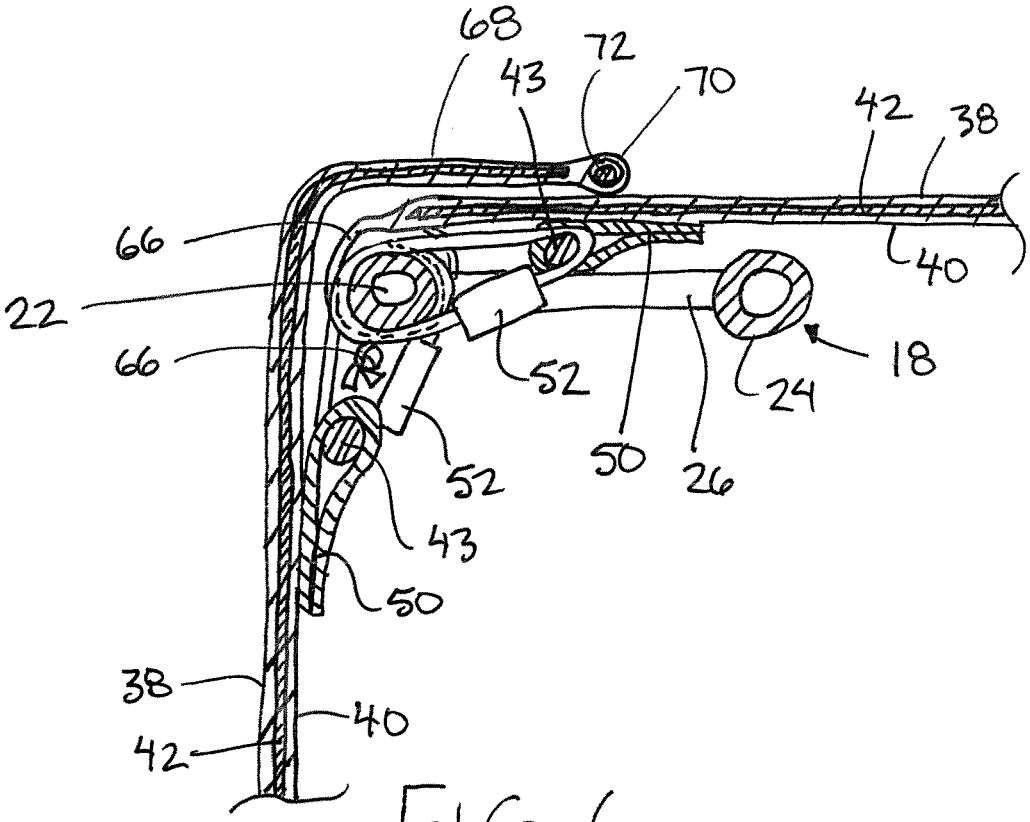
FIG. 6 is a sectional view along the line 6-6 in FIG. 5.
Figure 7:
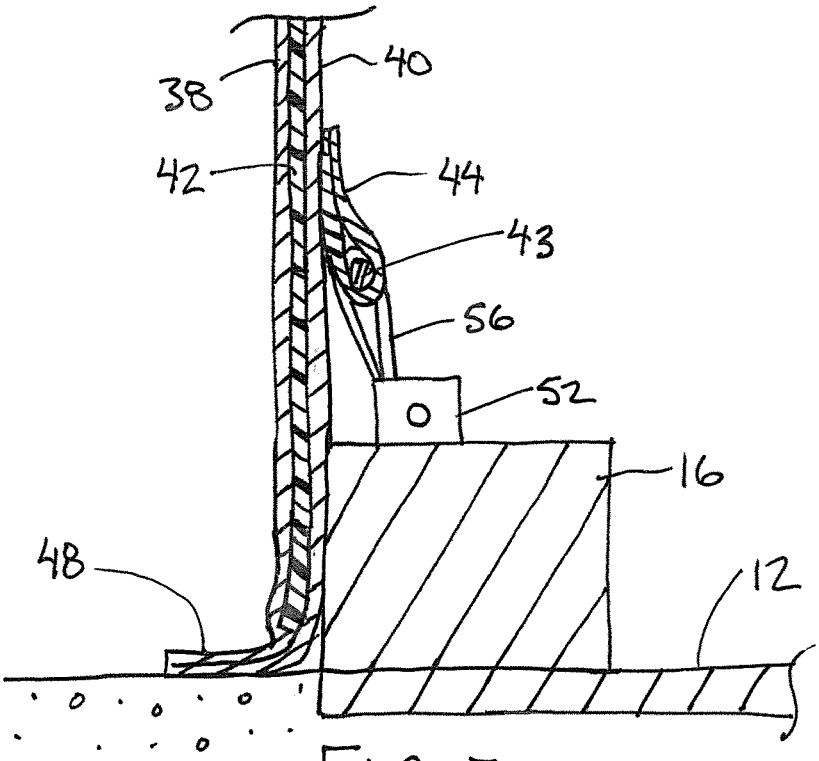
FIG. 7 is an enlarged portion of the sectional view along the line 3-3 in FIG. 1 illustrating the securement of one end of the side wall sheet assembly to the floor of the rigid frame of the building according to FIG. 1.
Figure 8:
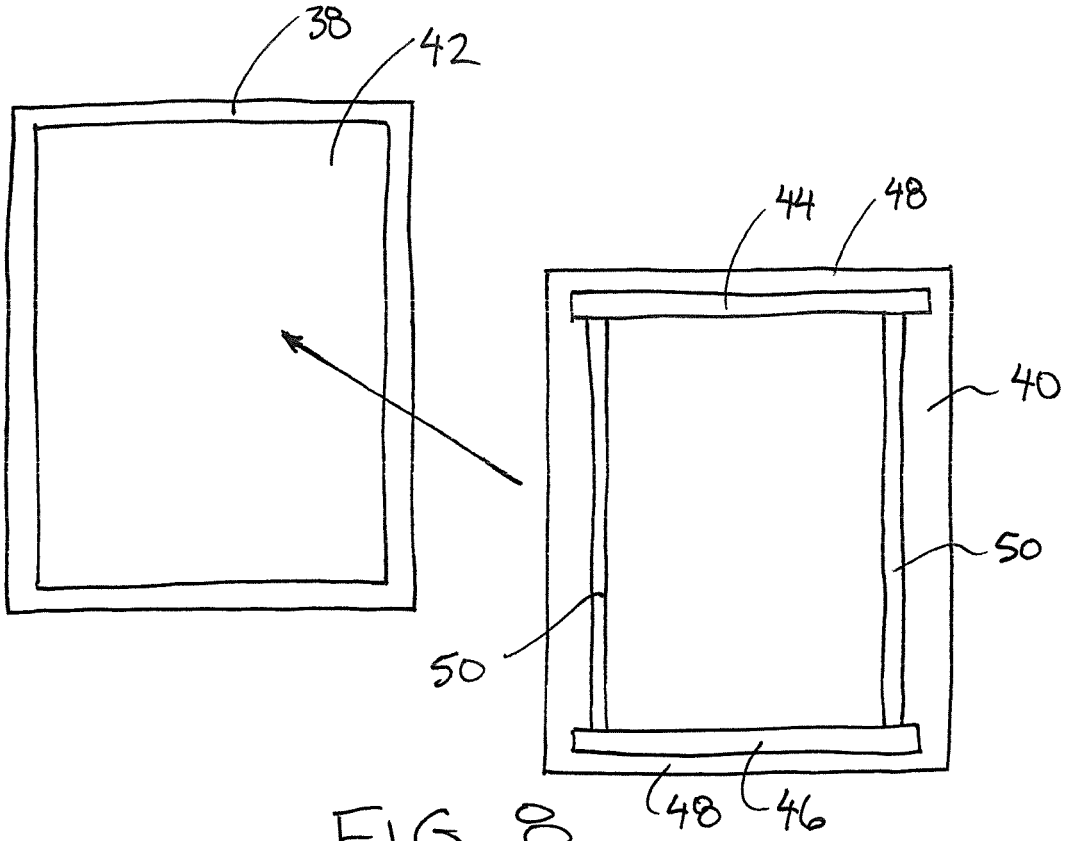
FIG. 8 is a partially exploded schematic representation of the inner sheet member, the outer sheet member and the core layer of the flexible sheet assembly used in the building according to FIG. 1.

The flexible sheet assembly for forming the curved side wall of the building includes the first and second longitudinal tension pockets 44 and 46 at longitudinally opposed ends to receive respective frame members that are secured at the sides of the foundation of the building, and two lateral tension pockets 50 at laterally opposed side edges that are secured to the outermost arched trusses at the opposing ends of the building respectively. The lateral pockets 50 are contained within the boundaries of the longitudinal tension pockets 44 and 46 while all pockets are spaced inward from the corresponding boundaries of the sheet assembly as shown in the illustrations of FIG. 4 and FIG. 8.

When the flexible sheet assembly of the side wall system extends over the arched trusses, a first frame member in the first longitudinal tension pocket 44 is connected by a plurality of the tension devices 52 between the first frame member and the corresponding row of concrete blocks along that side of the foundation of the building. Similarly, a second frame member in the second longitudinal tension pocket 46 is connected by a plurality of the tension devices 52 between the second frame member and the corresponding row of concrete blocks along that side of the foundation of the building. The tension devices in this instance comprise winch bodies fixed to the concrete blocks receiving straps that are looped about the frame members so that tightening the winches shortens the straps and applies longitudinal tension to the sheet assembly in a circumferential direction of the arched side wall.

Due to the lateral tension pockets 50 in this instance following the curvature of the arched trusses, the corresponding frame members received within the lateral pockets likewise follow the curvature of the arched trusses. The lateral frame members within the lateral pockets 50 are situated to be positioned spaced slightly longitudinally inward from the outermost arched trusses respectively so that the tension devices can be connected longitudinally of the building at spaced positions along each curved lateral frame member and the corresponding outermost arched truss to apply tension in the lateral direction of the sheet assembly corresponding to the longitudinal direction of the building.

The end portion 48 of the sheet assembly protruding beyond the lateral pocket at each end of the building in this instance has a suitable length for spanning from the lateral pocket to the corresponding outermost truss and beyond the end truss by a substantial distance in the order of greater than 1 foot for example. In this manner, an end flap 68 is defined that can be folded radially inward to overlap a corresponding upright exterior surface portion of the end wall adjacent to the curved upper perimeter of the end wall. A gathering pocket 70 is formed to extend along the outer edge of the flexible sheet of the side wall system at both ends of the building so that a gathering member 72 received within the gathering pocket 70 can be used to gather or cinch the end flap 58 radially inward into overlapping arrangements against a corresponding portion of the end wall.

Along both longitudinally extending sides of the building, the end portions 48 at longitudinally opposed ends of the flexible sheet assembly of the side wall system also have sufficient length to extends from the longitudinal tension pockets 44 and 46 to the ground and beyond so that a resulting end portion 48 can also overlap a portion of the ground about the perimeter of the building similarly to the bottom of the end walls. Weighted material can be placed on the flaps to secure the bottom edges of the side wall system relative to the foundation at the end portion which is not tensioned by the longitudinal tension pockets. Similarly to the end walls, the core layer preferably extends beyond the longitudinal tension pockets 44 and 46 by a distance at least corresponding to the height of the tension pockets from the ground to maximize the insulated boundary of the building.

Figure 9:
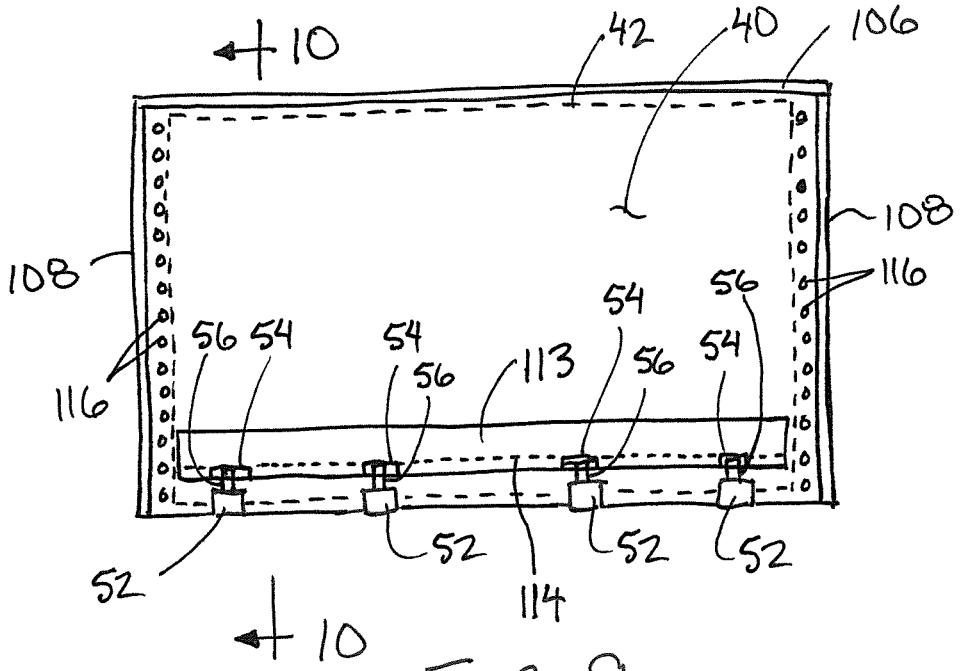
FIG. 9 is an inner side elevational view of a flexible sheet assembly according to a second embodiment of the present invention.
Figure 10:
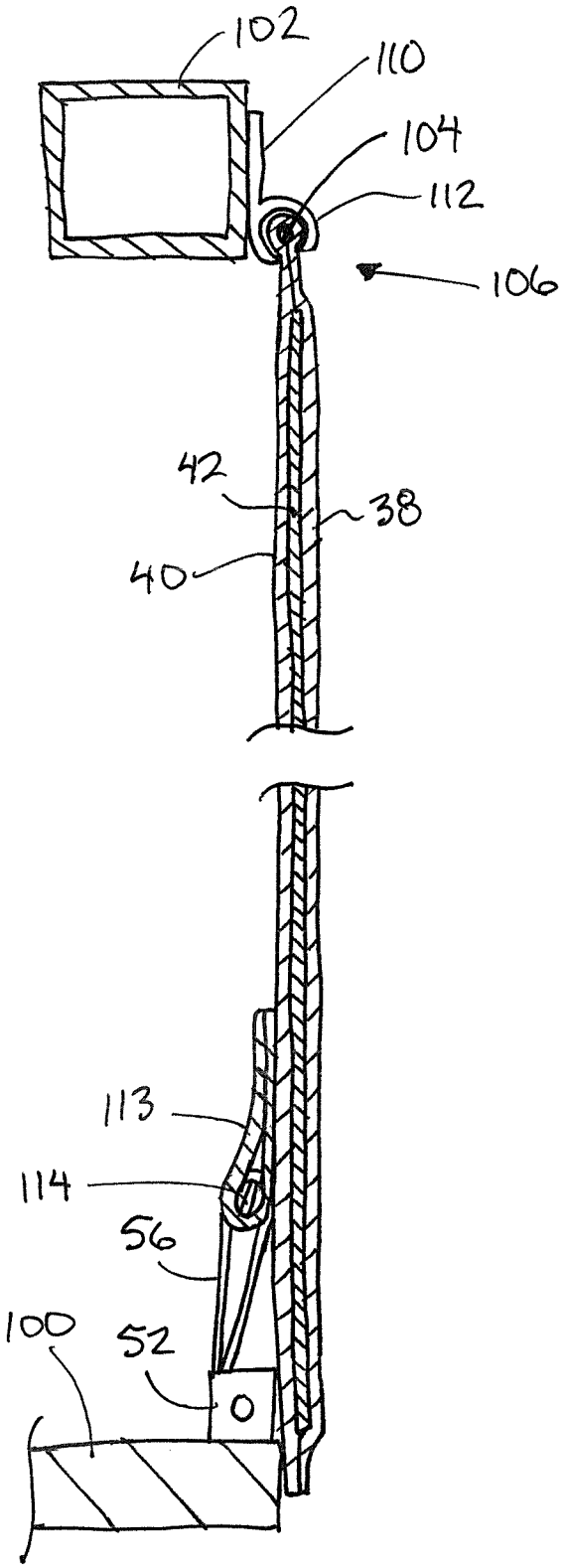
FIG. 10 is a sectional view along the line 10-10 in FIG. 9 illustrating the flexible sheet assembly spanning an opening in the rigid frame of a building.

Turning now to FIGS. 9 and 10, in this instance the tensioned wall system according to the present invention is provided as a temporary wall spanning across a vertical building opening in a building frame. In this instance the building frame again includes a floor 100 which may be formed by a foundation or a structural elevated floor in a building while a plurality of perimeter frame members 102 extend about the sides and across the top of the building opening. The flexible sheet assembly in this instance includes an identical arrangement of layers so as to include an outer sheet member 38, an inner sheet member 40 and a core layer 42 as described above. Again, the core layer 42 is undersized relative to the inner and outer sheet members so that the inner and outer sheet members can be plastic welded to one another about the full perimeter of the sheet assembly to fully encapsulate the core layer 42. The core layer can also be bonded by adhesive across the full width and length thereof at the opposing first and second sides of the core layer to the outer sheet member and the inner sheet member respectively, also as described above.

The wall system in this instance differs from the previous embodiment in that an integral bead 104 is fused into the sheet assembly between the inner and outer sheet members within the perimeter boundary portion that is devoid of the core layer. In this manner, the integral bead 104 is fused to the sheet members about the top edge 106 and the two side edges 108 of the sheet assembly. Each bead comprises a strand of material of increased thickness relative to the remainder of the sheet assembly.

In this instance, a first frame member 110 is mounted along the perimeter frame member 102 across the top of the building opening in which the first frame member is a rigid structural member including a hollow channel 112 formed therein of dimensions which closely fit the integral bead 104 at the top edge 106 of the sheet assembly. The hollow channel 112 is slotted at the bottom side thereof through which the flexible sheet can communicate while the bead 104 remains retained within the hollow channel 112. The first frame member thus secures the top edge of the flexible sheet assembly relative to the building frame while applying longitudinal tension to the sheet assembly.

A tension pocket 113 is provided on the inner sheet member at a location spaced upwardly from the second end (bottom end) of the sheet assembly consistent with the configuration of the second longitudinal tension pocket 46 according to the previous embodiment. A second frame member 114 is received within the tension pocket 113 to span the full width in the lateral direction. The second frame member 114 is a rigid bar to which force can be applied by a plurality of the tension devices 52 connected between the floor and the second frame member to apply tension to the sheet assembly in the longitudinal direction.

As in the previous embodiment, tension is applied primarily to the inner sheet member of the sheet assembly by the tension devices; however, tension is distributed through the core layer and the outer sheet member by the bonding between the layers and/or the perimeter connection between the inner and outer sheet member.

The sheet assembly according to FIGS. 9 and 10 further differs from the previous embodiment by a row of grommets 116 extending along each of the laterally opposing side edges of the sheet member. The grommets are aligned with the plastic welding of the inner and outer sheet members at the boundary thereof so as to be spaced laterally outward from the lateral boundary of the core layer of insulation to provide a stronger securement of the grommet relative to the sheet assembly. The grommets enable ties to be threaded through the grommet openings to tie adjacent sheet assemblies together when a plurality of sheet assemblies are connected side-by-side in a laterally extending row.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. An insulated wall system for a building including a rigid frame defining a wall opening spanning between first and second ends, the wall system comprising:

a flexible sheet assembly spanning a length in a longitudinal direction between opposing first and second ends of the flexible sheet assembly and spanning a width in a lateral direction perpendicular to the longitudinal direction between opposing sides of the flexible sheet assembly, the flexible sheet assembly comprising:

(i) an outer sheet member defining a first plastic barrier spanning an exterior side of the flexible sheet assembly;

(ii) an inner sheet member defining a second plastic barrier spanning an interior side of the flexible sheet assembly and being joined to the outer sheet member along perimeter edges of the sheet members;

(iii) a core layer formed of a heat insulating material received between the inner and outer sheet members; and (iv) a tension pocket formed on the inner sheet member to extend in the lateral direction across the flexible sheet assembly in proximity to the second end of the flexible sheet assembly;

a first frame member arranged to be secured to the flexible sheet assembly in proximity to the first end of the flexible sheet assembly so as to span across the flexible sheet assembly in the lateral direction of the flexible sheet assembly, the first frame member being arranged to be secured relative to the rigid frame of the building at the first end of the wall opening;

a second frame member arranged to be received in the tension pocket to extend in the lateral direction across the flexible sheet assembly in proximity to the second end of the flexible sheet assembly; and a tensioning assembly arranged to be operatively connected between the second frame member and the rigid frame of the building at the second end of the wall opening whereby the tensioning assembly is arranged to apply tension in the longitudinal direction to the inner sheet member of the flexible sheet assembly between the first and second frame members.

2. The system according to claim 1 wherein the core layer is bonded to the outer sheet member along a first side of the core layer and bonded to the inner sheet member along a second side of the core layer such that the outer sheet member and the inner sheet member are integrally joined to one another across the length and across the width of the flexible sheet assembly.

3. The system according to claim 1 wherein the outer sheet member and the inner sheet member are joined to one another at the first and second ends by plastic welds between peripheral portions of the first plastic barrier and the second plastic barrier extending fully across the width of the flexible sheet assembly.

4. The system according to claim 1 wherein the outer sheet member and the inner sheet member are joined to one another by plastic welds between the first plastic barrier and the second plastic barrier extending about a full perimeter of the flexible sheet assembly at the perimeter edges of the sheet members.

5. The system according to claim 1 wherein the core layer comprises a flexible sheet of material encapsulating air pockets therein in which the core layer is bonded fully across first side to the inner sheet member and bonded fully across the second side to the outer sheet member.

6. The system according to claim 1 wherein the flexible sheet assembly further comprises an auxiliary pocket formed on the inner sheet member to extend in the lateral direction across the flexible sheet assembly in proximity to the first end of the flexible sheet assembly, the auxiliary pocket being arranged to receive the first frame member therein, the system further comprises an auxiliary tensioning assembly arranged to be operatively connected between the first frame member and the rigid frame of the building at the first end of the wall opening whereby the auxiliary tensioning assembly is arranged to apply further tension in the longitudinal direction to the inner sheet member of the flexible sheet assembly between the first and second frame members.

7. The system according to claim 1 wherein the flexible sheet assembly comprises a plurality of pockets formed on the inner sheet member and arranged to receive respective frame members therein such that the frame members extend about a full perimeter of the flexible sheet assembly, and wherein the system further comprises a plurality of tensioning assemblies operatively connected between the frame members and the rigid frame of the building about a perimeter of the wall opening whereby the tensioning assemblies are arranged to apply tension across the inner sheet member in both the longitudinal direction and the lateral direction.

8. The system according to claim 1 wherein the rigid frame of the building includes a foundation defining a floor, arched trusses defining a semi-cylindrical wall supported along opposing sides of the floor, and two end frames defining end walls of the building at opposing ends of the semi-cylindrical wall, the system further comprising:

the flexible sheet assembly being arranged to extend over one or more of the arched trusses between the first and second ends of the flexible sheet assembly supported along the opposing sides of the floor of the building.

9. The system according to claim 8 wherein the flexible sheet assembly further comprises an auxiliary pocket formed on the inner sheet member to extend in the lateral direction across the flexible sheet assembly in proximity to the first end of the flexible sheet assembly, the auxiliary pocket being arranged to receive the first frame member therein, said tensioning assembly being arranged to be operatively connected between the second frame member and a first one of the sides of the floor of the building, the system further comprises an auxiliary tensioning assembly arranged to be operatively connected between the first frame member and a second one of the sides of the floor of the building.

10. The system according to claim 8 further comprising an end flap protruding in a lateral direction from one side edge of the flexible sheet assembly along an upper perimeter of a corresponding one of the end walls of the building, the end flap including a gathering pocket therein arranged to receive a gathering member such that the gathering member is arranged to constrict the end flap radially inwardly into overlapping arrangement with an upright exterior surface portion of the corresponding end wall.

11. The system according to claim 1 wherein the rigid frame of the building includes a foundation defining a floor, arched trusses defining a semi-cylindrical wall supported along opposing sides of the floor, and two end frames defining end walls of the building at opposing ends of the semi-cylindrical wall, the system further comprising:

the flexible sheet assembly being arranged to extend over one of the end walls between the floor and one of the arched trusses of the building.

12. The system according to claim 11 wherein the flexible sheet assembly further comprises an auxiliary pocket formed on the inner sheet member in proximity to the first end of the flexible sheet to extend across the flexible sheet assembly along a semicircular path following an upper end of the end wall of the building, the auxiliary pocket being arranged to receive the first frame member therein, said tensioning assembly being arranged to be operatively connected between the second frame member and the floor of the building, the system further comprises an auxiliary tensioning assembly arranged to be operatively connected between the first frame member and one of the arched trusses of the rigid frame of the building.

13. The system according to claim 12 wherein the auxiliary tensioning assembly is arranged to apply tension to the flexible sheet assembly in a radial direction towards said one of the arched trusses.

14. The system according to claim 12 wherein the flexible sheet assembly further comprises (i) a door opening open to the second end of the flexible sheet assembly adjacent to the floor of the building, and (ii) a pair of intermediate pockets formed on the inner sheet member to extend between an upper boundary of the door opening and the first end of the flexible sheet member adjacent to laterally opposing ends of the upper boundary respectively, the system further comprising (i) an intermediate frame member received in each intermediate pocket and (ii) intermediate tension assemblies arranged to be operatively connected between the intermediate frame members and the rigid frame of the building so as to apply tension to the flexible sheet assembly above the door opening in a lateral direction.

15. The system according to claim 1 wherein the outer sheet member and the inner sheet member are joined to one another by plastic welds between the first plastic barrier and the second plastic barrier extending about a full perimeter of the flexible sheet assembly at the perimeter edges of the sheet members, the flexible sheet assembly further comprising a row of grommets mounted along each side of the flexible sheet member within the peripheral portions of the inner and outer sheet members.

* * * * *